US006933676B2

(12) United States Patent
Raunig

(10) Patent No.: US 6,933,676 B2
(45) Date of Patent: Aug. 23, 2005

(54) DRIVER CIRCUIT FOR A VACUUM FLUORESCENCE DISPLAY

(75) Inventor: Bernd Raunig, Berlin (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 73 days.

(21) Appl. No.: 10/447,652

(22) Filed: May 29, 2003

(65) Prior Publication Data

US 2003/0230987 A1 Dec. 18, 2003

(30) Foreign Application Priority Data

Jun. 12, 2002 (DE) ..... 102 25 996

(51) Int. Cl.[7] ..... H01J 13/46

(52) U.S. Cl. ..... 315/46; 315/98; 313/495; 313/496

(58) Field of Search ..... 313/495, 496; 315/46, 49, 94, 98, 99

(56) References Cited

U.S. PATENT DOCUMENTS

| | | | | |
|---|---|---|---|---|
| 3,761,766 A | | 9/1973 | Hatano et al. | 315/84.6 |
| 4,859,912 A | | 8/1989 | Lippmann et al. | 315/169.3 |
| 4,970,441 A | * | 11/1990 | Lippmann et al. | 315/337 |
| 5,155,413 A | * | 10/1992 | Bozzer et al. | 315/169.1 |
| 5,463,278 A | | 10/1995 | Gray | 315/169.1 |
| 5,563,622 A | * | 10/1996 | Person et al. | 345/75.1 |
| 2002/0118155 A1 | * | 8/2002 | Fluhrer | 345/87 |

FOREIGN PATENT DOCUMENTS

| | | |
|---|---|---|
| DE | 87 16 706.9 | 5/1989 |
| EP | 0 191 580 B1 | 8/1993 |
| GB | 2 216 700 A | 10/1989 |
| GB | 2 332 296 A | 6/1999 |
| JP | 02 101 879 A | 4/1990 |
| JP | 09/152 845 A | 6/1997 |

* cited by examiner

*Primary Examiner*—Tuyet Thi Vo
(74) *Attorney, Agent, or Firm*—Laurence A. Greenberg; Werner H. Stemer; Ralph E. Locher

(57) ABSTRACT

A vacuum fluorescence display has a plurality of heating regions and heating inputs corresponding thereto. A driver circuit for the VFD has a driver module with a pulse width-modulatable output connected by way of a distributor to a plurality of heating inputs of the VFD. A switching member is connected between the distributor and one or more of the heating inputs.

13 Claims, 2 Drawing Sheets

DRIVER CIRCUIT FOR A VACUUM FLUORESCENCE DISPLAY

BACKGROUND OF THE INVENTION

Field of the Invention

The invention pertains to a driver circuit for a vacuum fluorescence display (VFD) with a plurality of heating regions and heating inputs corresponding to the heating regions. There is provided an actuating module with a pulse width-modulated (PWM) output. The invention also pertains to a vacuum fluorescence display having such a driver circuit, and to a timer switch having such a vacuum fluorescence display.

The heating of a VFD is mostly controlled by way of pulse width modulation (PWM). For that purpose there must be an actuating module with a pulse width-modulatable (PWM) output. Often a VFD has a plurality of separate heating regions, in which case for example one is used to display the clock time and another is used to display symbols or characters. By virtue of the separation of those various heating regions it is possible to cause only a part of the possible display elements to light up while the other display elements remain dark, thereby affording a power saving when individual display elements are not required.

The separate heating regions however also have to be actuated separately so that, for each heating region of the VFD, there must be a PWM-capable output on the actuating module. That in turn means that the actuating module is more complicated and expensive to construct and is thus also more costly.

SUMMARY OF THE INVENTION

It is accordingly an object of the invention to provide a driver circuit for a vacuum fluorescence display which overcomes the above-mentioned disadvantages of the heretofore-known devices and methods of this general type and in which a simpler driving module can be used.

With the foregoing and other objects in view there is provided, in accordance with the invention, a driver circuit for a vacuum fluorescence display with a plurality of heating regions and heating inputs corresponding thereto, comprising:

- a driver module with a pulse width-modulatable output; and
- a distributor connected between the pulse width-modulatable output and a plurality of the heating inputs of the vacuum fluorescence display.

With the above and other objects in view there is also provided, in accordance with the invention, a vacuum fluorescence display device, comprising a plurality of heating regions, a plurality of heating inputs corresponding to the heating regions, and a VFD driver circuit as summarized above connected to the heating inputs.

Finally, there is provided a timeswitch of a stove which includes such a vacuum fluorescence display (VFD).

By using the distributor between the PWM-output of the actuating module and the heating inputs of the VFD, it is possible to actuate a plurality of heating regions of the VFD by way of a single PWM-output.

In a preferred embodiment, there is/are connected, upstream or downstream of the distributor, one or more amplifiers into the connection between the PWM-output and the heating inputs. The amplifiers raise the signal level.

In accordance with an added feature of the invention, a switching member is connected into the feed lines between the distributor and the heating inputs. This permits the separate actuation of individual heating regions.

In a preferred embodiment the amplifier is connected between the distributor and the heating input and the switching member is connected between the distributor and the amplifier. That keeps the switching power of the switching member low.

The amplifier and the switching member can also be combined in the form of a switching amplifier which is connected between the distributor and the heating input.

The switching functions of the switching member are controlled by way of an output of the actuating module that is not a pulse width-modulatable output. This keeps down the structural complication and expenditure and thus also the costs of the actuating module.

The switching member may be in the form of a series switch (that is to say, it is connected in series) or in the form of a short-circuit switch (that is to say, it is connected in parallel).

The distributor is preferably formed by a resistor network.

A plurality of pulse width-modulatable outputs can be provided at the actuating module, but in that case the number of said outputs is less than the number of the heating inputs of the VFD and at least two heating inputs are connected by way of a distributor to a PWM-output.

Other features which are considered as characteristic for the invention are set forth in the appended claims.

Although the invention is illustrated and described herein as embodied in a driver circuit for a vacuum fluorescence display, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
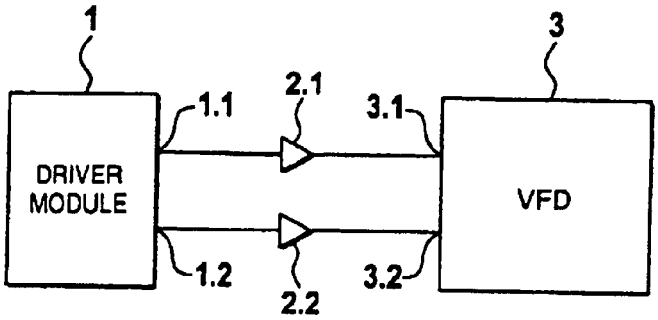
Fig. 1 PRIOR ART
FIG. 1 is a block diagram of a prior art driver circuit with a display.

Referring now to the figures of the drawing in detail and first, particularly, to FIG. 1 thereof, there is shown a prior art driver module 1 formed by a microcontroller. The module 1 has two outputs 1.1 and 1.2 which respectively deliver pulse width-modulated signals. The signals of those PWM-outputs 1.1 and 1.2 are amplified by amplifiers 2.1 and 2.2 and passed to heating actuating inputs 3.1 and 3.2 (also referred to as filament pins or firing inputs) of a vacuum fluorescence display (VFD) 3.

Figure 2:
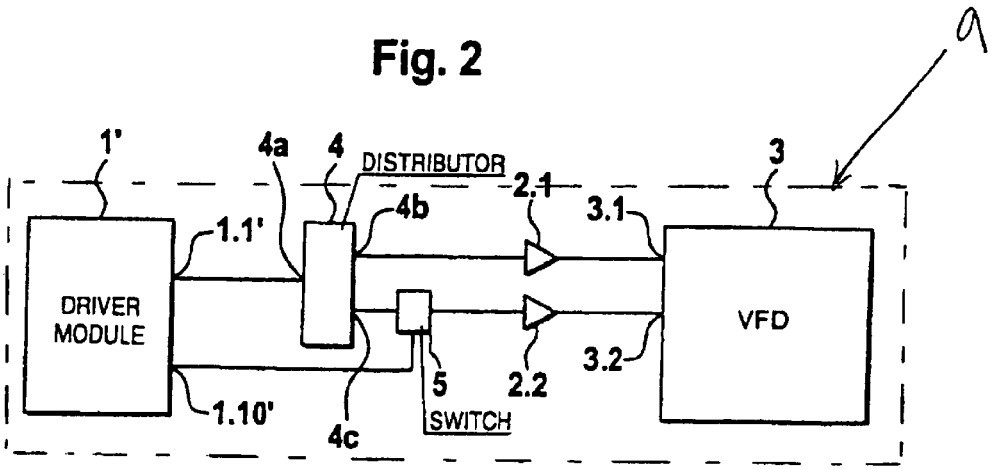
FIG. 2 is a block diagram of a driver circuit according to the invention.

Referring now to FIG. 2, the driver module 1' according to the invention has only one PWM-output 1.1'. The pulse width-modulated signal from that output 1.1' passes by way of a distributor 4 and two amplifiers 2.1 and 2.2 to the filament pins, i.e., the heating inputs 3.1 and 3.2 of the VFD 3. A switching member 5 is connected between the distributor 4 and the amplifier 2.2. The switching member 5 is switched by way of a simple, that is to say non-pulse width-modulated output 1.10' of the actuating module 1'.

The heating system of the VFD 3 that is actuated by way of the heating input 3.1, is continuously supplied with the pulse width-modulated signal from the output 1.1'. It belongs to a clock display of a stove timer switch 9 which is intended to be constantly lit. The second heating input 3.2 is only supplied with the pulse width-modulated signal from the output 1.1' when the switching member 5 is connected through. The heating region of the VFD, which belongs to that input 3.2, serves for the display of symbols or characters in the stove timer switch 9 which do not have to be continuously lit. When that display is not required the switching member S receives by way of the output 1.10' a signal for switching off the second heating region.

The advantage of the invention over the state of the art is that there is no longer any need to provide two pulse width-modulated outputs in the driver module 1. Instead, we provide only one PWM-output 1.1' and a simple output 1.10' which is not pulse width-modulated. In that way the driver module 1' can be of a simpler construction and can thus also be less expensive.

Figure 3:
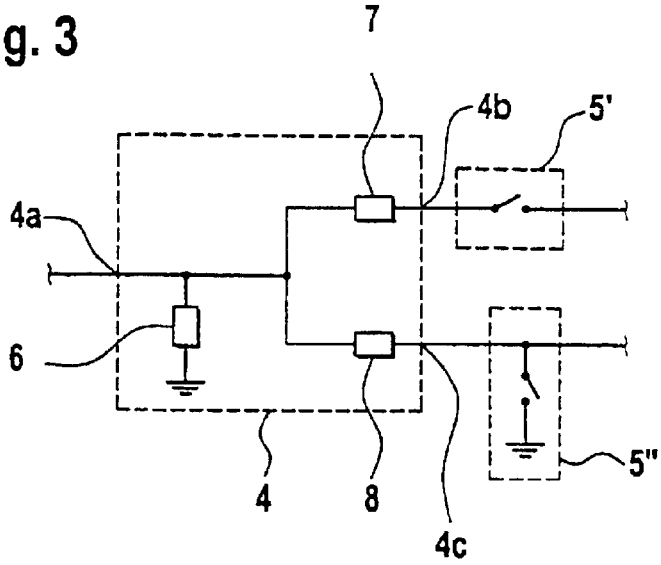
FIG. 3 is a schematic of an embodiment of a distributor and two switching members in accordance with the invention.

Referring now to FIG. 3, the distributor 4 has a resistor 6 grounding its input 4*a*, for voltage stabilization purposes. Upstream of its outputs 4*b* and 4*c*, as seen in the signal flow direction, the distributor 4 has two separating resistors 7 and 8 for decoupling the arms connected to the outputs 4*b* and 4*c*. The switching member 5 can be connected in series (series switch 5') or in parallel (short-circuit switch 5").

Figure 4:
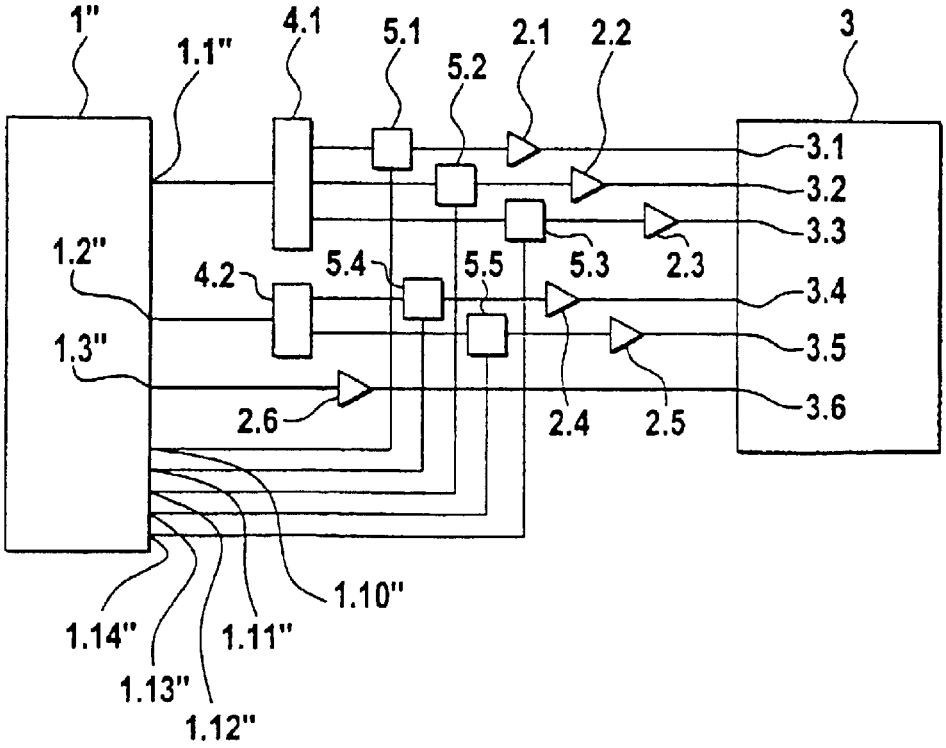
FIG. 4 is a schematic of a further embodiment of the driver circuit according to the invention.

With reference to FIG. 4, the signal of a PWM-output 1.1" can also be passed to three heating inputs 3.1, 3.2 and 3.3 of the VFD 3. For that purpose the signal is distributed by way of the distributor 4.1 to three arms, each with a switching member 5.1, 5.2 and 5.3, respectively, and an amplifier 2.1, 2.2 and 2.3, respectively. Another PWM-output 1.2" can be distributed by way of the distributor 4.2 only to two arms and can be passed by way of switching members 5.4 and 5.5 respectively and amplifiers 2.4 and 2.5 respectively to two heating inputs 3.4 and 3.5 respectively. It will be appreciated that, in addition, a PWM-output 1.3" can also be connected directly to only one heating input 3.6, in which case only one amplifier 2.6 has to be connected therebetween. The switching members 5.1 to 5.5 are driven by way of non-pulse width-modulated outputs 1.10" to 1.14".

Besides the illustrated embodiments, distribution to four or more arms is also possible. Switching members and amplifiers can also be combined in the form of a switching amplifier. For the purposes of actuating heaters for the VFD 3 which belong to permanently lit displays, there is no need to interpose a switching member 5. The switching members 5 can also be connected between the amplifiers and the heating inputs.

It is possible with the present invention to selectively supply a higher number of heating actuating inputs, i.e., heating inputs, with pulse width-modulated signals, with a low number of pulse width-modulated outputs at the driver module.

I claim:

1. A driver circuit for a vacuum fluorescence display with a plurality of heating regions and heating inputs corresponding thereto, comprising:

a driver module with a pulse width-modulatable output; and a distributor connected between said pulse width-modulatable output and a plurality of the heating inputs of the vacuum fluorescence display.

2. The driver circuit according to claim 1, which comprises a plurality of amplifiers connected between said pulse width-modulatable output and respective heating inputs.

3. The driver circuit according to claim 1, wherein said distributor is a resistor network.

4. The driver circuit according to claim 1, wherein said pulse width-modulatable output of said driver module is one of a plurality of pulse width-modulatable outputs, and a number of said plurality of pulse width-modulatable outputs is smaller than a number of the heating inputs of the VFD, and wherein at least two heating inputs are connected to a respective width-modulatable output through said distributor.

5. The driver circuit according to claim 1, which comprises at least one amplifier connected between said pulse width-modulatable output and the heating inputs.

6. The driver circuit according to claim 5, wherein said amplifier is connected between said distributor and a respective heating input, and a switching member is connected between said distributor and said amplifier.

7. The driver circuit according to claim 1, which comprises a switching amplifier connected between said distributor and one or more of the heating inputs of the vacuum fluorescence display.

8. The driver circuit according to claim 7, wherein said driver module further has a non-pulse width-modulatable output connected to said switching amplifier for driving said switching amplifier.

9. A vacuum fluorescence display device, comprising a plurality of heating regions, a plurality of heating inputs corresponding to said heating regions, and a driver circuit according to claim 1 connected to said heating inputs.

10. In a timer switch of a stove, a vacuum fluorescence display according to claim 9.

11. The driver circuit according to claim 1, which comprises a switching member connected between said distributor and one or more of the heating inputs.

12. The driver circuit according to claim 11, wherein said driver module further has a non-pulse width-modulatable output connected to said switching member for driving a switching function of said switching member.

13. The driver circuit according to claim 11, wherein said switching member is a series switch or a short-circuit switch.

* * * * *